US006182886B1

(12) United States Patent
Tucker et al.

(10) Patent No.: US 6,182,886 B1
(45) Date of Patent: Feb. 6, 2001

(54) ENVELOPE CONSTRUCTION

(75) Inventors: Michael E. Tucker; Jeffrey L. Quiett; John E. Cummings, all of Topeka, KS (US)

(73) Assignee: Hallmark Cards, Incorporated, Kansas City, MO (US)

( * ) Notice: Under 35 U.S.C. 154(b), the term of this patent shall be extended for 0 days.

(21) Appl. No.: 09/405,730

(22) Filed: Sep. 24, 1999

(51) Int. Cl.[7] ..... B65D 27/00
(52) U.S. Cl. ..... 229/68.1
(58) Field of Search ..... 229/68.1, 71, 72, 229/308, 315

(56) References Cited

U.S. PATENT DOCUMENTS

| | | | | |
|---|---|---|---|---|
| 331,355 | | 12/1885 | Williams . | |
| 453,892 | * | 6/1891 | Parkhurst | 229/72 |
| 500,996 | * | 7/1893 | Cutter | 229/72 |
| 1,098,175 | * | 5/1914 | Schnitzler | 229/315 |
| 1,185,767 | * | 6/1916 | Cather et al. | 229/68.1 X |
| 1,295,833 | * | 3/1919 | Allen | 229/72 |
| 1,409,829 | * | 3/1922 | Chambon | 229/71 X |
| 1,470,291 | | 10/1923 | Sawdon . | |
| 1,558,306 | | 10/1925 | Snape . | |
| 1,559,132 | | 10/1925 | Trenchard . | |
| 1,858,277 | | 5/1932 | Overly . | |
| 1,964,595 | | 6/1934 | Overly . | |
| 2,055,716 | | 9/1936 | Berkowitz . | |
| 2,317,497 | | 4/1943 | Thompson . | |
| 2,877,944 | * | 3/1959 | Hyman | 229/72 X |
| 2,997,225 | * | 8/1961 | Whitman | 229/71 |
| 3,013,713 | * | 12/1961 | Whitman | 229/71 |
| 3,043,506 | * | 7/1962 | Bremer | 229/68.1 X |
| 3,642,195 | | 2/1972 | Tulisalo . | |
| 4,129,214 | | 12/1978 | Gendron . | |
| 4,204,600 | | 5/1980 | Pritchard . | |
| 4,444,356 | | 4/1984 | Hays . | |

FOREIGN PATENT DOCUMENTS

| | | | | |
|---|---|---|---|---|
| 296705 | * | 2/1916 | (DE) | 229/308 |
| 1 225 842 | * | 3/1971 | (GB) | 229/71 |

* cited by examiner

*Primary Examiner*—Jes F. Pascua
(74) *Attorney, Agent, or Firm*—Pillsbury Madison & Sutro, LLP

(57) ABSTRACT

A rectangular envelope for square articles includes a rectangular front panel having a pair of shorter edges and a pair of longer edges. A sealing flap is attached to one of the shorter edges and a back flap is attached to the other shorter edge, A pair of side flaps are attached to the longer edges. The side flaps are folded along the longer sides over the front panel. The back flap is folded along the other shorter side over the front panel and the folded over side flaps. A filler sheet is disposed between the back flap and the front panel adjacent said other shorter edge and between the folded over side flaps. The filler sheet is adhered to the front panel and the back flap. The back flap is adhered to the side flaps. The filler sheet defines a substantially square article holding envelope portion between the filler sheet and the first shorter edge of the front panel.

21 Claims, 1 Drawing Sheet

ENVELOPE CONSTRUCTION

FIELD OF THE INVENTION

The present invention relates generally to the field of mailing or postal envelopes, and more particularly to a rectangular envelope of square articles, such as social expression cards, and a method of making same.

DESCRIPTION OF THE PRIOR ART

The social expression card industry is a very large business. Consumers demand a variety of card styles, designs, artwork, and sentiments in order to express properly the thoughts they wish to convey to the recipient. Accordingly, social expression card manufacturers constantly create new cards in order to satisfy consumer demand.

One style of card is a line of square cards, having dimensions of, for example, 5 ¼ inches by 5 ¼ inches, which are different from more traditional rectangular cards. Social expression cards are usually sold along with an envelope that is sized and shaped for the card. Consumer research indicates that consumers expect that a card fit smoothly and fairly tightly within an envelope. Accordingly, consumers prefer an envelope that is about the same shape as, and slightly larger than, the card. Thus, in order to satisfy customers, square cards should be sold with square envelopes.

Current Postal Service regulations require that envelopes meet a minimum aspect ratio, so that the envelopes may be processed smoothly by automated sorting equipment. The aspect ratio is calculated by dividing the length of an envelope by the width. The minimum acceptable aspect ratio for envelopes is 1.3. Envelopes not meeting Postal Service minimum aspect ratio regulations may require extra postage in order to complete delivery.

In order to meet Postal Service aspect ratio regulations, it is thus necessary to mail a square card in a rectangular envelope. However, a square card will slide around in a rectangular envelope, which gives the consumer the impression that the card is not matched to the envelope. Accordingly, is an object of the present invention to provide in envelope that is fitted to a square card, but which meets Postal Service aspect ratio regulations.

SUMMARY OF THE INVENTION

The present invention provides a rectangular envelope for square articles and a method of making same. The envelope includes a rectangular front panel having a pair of shorter edges and a pair of longer edges. A sealing flap is attached to one of the shorter edges and a back flap is attached to the other shorter edge, A pair of side flaps are attached to the longer edges. The side flaps are folded along the longer sides over the front panel. The back flap is folded along the other shorter side over the front panel and the folded over side flaps. A filler sheet is disposed between the back flap and the front panel adjacent said other shorter edge and between the folded over side flaps. The filler sheet is adhered to the front panel and the back flap. The back flap is adhered to the side flaps. The filler sheet defines a substantially square article holding envelope portion between the filler sheet and the first shorter edge of the front panel.

DESCRIPTION OF THE PREFERRED EMBODIMENT

Figure 1:
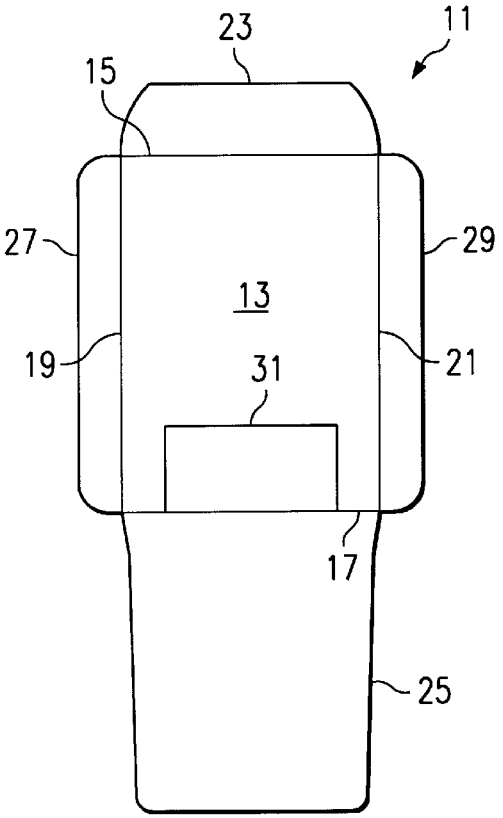
FIG. 1 is a view of an envelope according to the present invention, unfolded, with the filler sheet positioned on, and adhered to, the front panel.

Referring now to the drawings, an envelope according to the preferred embodiment of the present invention is designated generally by the numeral 11. Envelope 11 is formed from a single sheet or continuous web of paper using an automated process generally well known to those skilled in the art. Envelope 11 includes a front panel 13 that is defined by a top shorter edge 15, a bottom shorter edge 17, and a pair of longer edges 19 and 21.

The ratio of the lengths of longer edges 19 and 21 to shorter edges 15 and 17 is at least about 1.3. For example, for a square 5 ¼" by 5 ¼" card, shorter edges 15 and 17 would be about 5.5" and longer edges 19 and 21 would be about 7 9/32", giving an aspect ratio of about 1.32.

Front panel 13 has attached thereto along top edge 15 a sealing flap 23. Front panel 13 also has attached thereto along bottom edge 17 a back flap 25. In the illustrated embodiment, back flap 25 has a length of about 6 ⅛". Finally, front panel 13 has attached thereto along side edges of 19 and 21 side flaps 27 and 29, respectively. In the illustrated embodiment, each side flap 27 and 29 has a width of about ¾".

According to the present invention, envelope 11 includes a rectangular filler sheet 31. Filler sheet 31 is made of paper stock of about the same thickness as the material of envelope 11. The material of filler sheet 31 may be selected to have a slightly higher adhesive absorbency than the material of envelope 11.

Filler sheet 31 is adhered to front panel 13 centered on bottom edge 17. Filler sheet 31 is preferably applied to front panel 13 at a window applying station. Adhesive is applied to front panel 13 at the appropriate place and filler sheet 31 is applied to the adhesive. The higher adhesive absorbency of the material of filler sheet 31 adheres filler sheet 31 strongly to front panel 13.

In the illustrated embodiment, filler sheet 31 has a length in the range of about 3 ¾ inches to about 4 inches, and a width in the range of about 1 ½ inches to about 1 ⅝ inches. Thus, the side edges of filler sheet 31 are spaced apart from side edges 19 and 21 about the width of side flaps 27 and 29. The top edge of filler sheet 31 is spaced apart from top edge 15 of front panel 15 about 5 ½", which is equal to the width of front panel 15.

Figure 2:
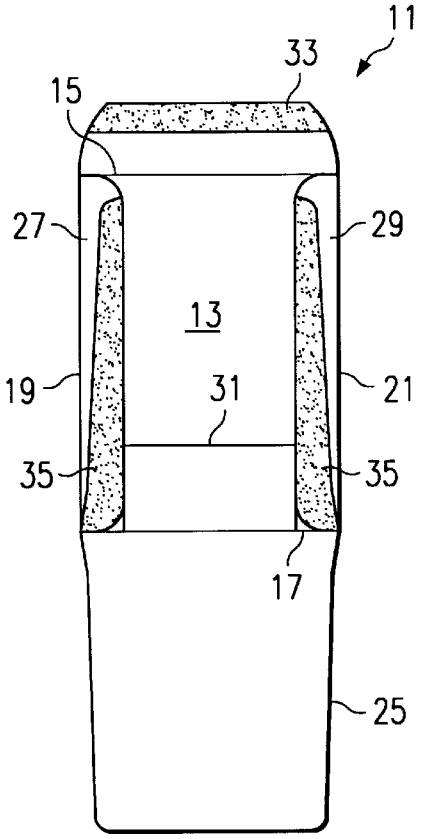
FIG. 2 is a view of the envelope of FIG. 1 with the side flaps folded, and with adhesive applied to the side flaps and the filler sheet.

After filler sheet 31 has been adhered to front panel 13, a remoistenable adhesive layer of adhesive 33 is applied to sealing flap 23, as shown in FIG. 2. Then, side flaps 27 and 29 are folded along longer edges 19 and 21, respectively, to the positions shown in FIG. 2. As shown in FIG. 2, folded-over side panels 27 and 29 nearly engage the side edges of filler sheet 31. Since filler sheet 31 is about the same thickness as side flaps 27 and 29, the side flaps 27 and 29 filler sheet 31 form an area at the bottom end of front panel 13 of substantially uniform thickness.

After side flaps 27 and 29 have been folded over, a layer of adhesive 35 is applied as shown in FIG. 2 to side flaps 27 and 29 and to filler sheet 31. Then, back flap 25 is folded along bottom edge 17 over front panel 13, folded-over side flaps 27 and 29, and filler sheet 31. Pressure is applied to firmly adhere side flaps 27 and 29 and filler sheet 31 to back flap 25. The substantially uniform thickness provided by side flaps 27 and 29 and filler sheet 31, along with the high adhesive absorbency of filler sheet 31, provides excellent adhesion in an automated envelope fabrication environment. The adhesion of front panel 13 and back flap 25 to filler sheet 31 is not likely to fail during use as might a simple glue line across the bottom interior portion of a rectangular envelope. Filler sheet 31 cooperates with front panel 13 and flaps 25, 27, and 29 to form a substantially square card holding area between the top edge of filler sheet 31, top edge 15 of front panel 13, and side edges 19 and 21.

Figure 3:
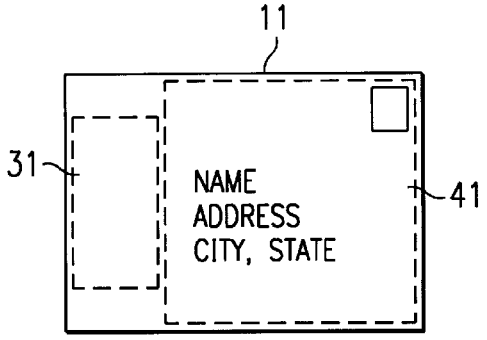
FIG. 3 is view of an envelope according to the present invention ready for mailing.

Referring now to FIG. 3, there is shown a completed envelope ready for mailing. A square card, shown in phantom at 41, is positioned in the card holding portion of envelope 11. As shown in FIG. 3, square card 41 fits well within the rectangular envelope 11, thereby meeting consumer demand for a proper card and envelope fit, while achieving the rectangular aspect ratio required by Postal Service regulations.

From the foregoing, it may be seen that the present invention is well suited to achieving the objects of the present invention. The present invention has been illustrated and described with respect to a presently preferred embodiment. Accordingly, the foregoing is intended for purposes of illustration rather than limitation. Those skilled in the art will recognize alternative embodiments, given the benefit of this disclosure. For example, alternative materials and sizes may be used, and alternative panel and flap arrangements may be employed, as all would be apparent to one skilled in the art, given the benefit of the foregoing description.

What is claimed:

1. An envelope, which comprises:

a rectangular front panel, said front panel having a pair of shorter edges and a pair of longer edges;

a sealing flap attached to a first of said shorter edges;

a pair of side flaps attached to said longer edges, said flaps being folded over said longer sides, each of said side flaps being of substantially equal width;

a back flap attached to the other of said shorter edges, said back flap being folded over said other shorter side and adhered to said side flaps;

a substantially rectangular filler sheet disposed between said folded over side flaps, said back flap and said front panel adjacent said other shorter edge, the total of the widths of said side flaps and said filler sheet being substantially equal to the width of said front panel, said filler sheet defining a substantially square card holding envelope portion between said filler sheet and said first shorter edge.

2. The envelope as claimed in claim 1, wherein said back flap is adhered to said filler sheet.

3. The envelope as claimed in claim 1, wherein said filler sheet is adhered to said front panel.

4. An envelope, which comprises:

a rectangular front panel defined by a pair of longer sides and a pair of shorter sides;

a sealing flap attached to one of said shorter sides;

a pair of side flaps attached to the longer sides and folded over said front panel along said longer sides;

a back flap attached to the other shorter side; and, a filler sheet adhered to said front panel between said folded over side flaps and adjacent said other shorter, said filler sheet having a length substantially equal to the distance between said folded over side flaps.

5. The envelope as claimed in claim 4, wherein said filler sheet has a width substantially equal the difference in length between said longer sides and said shorter sides.

6. The envelope as claimed in claim 4, wherein said side flaps are folded over said front panel along said longer sides.

7. The envelope as claimed in claim 4, wherein said back panel is adhered to said filler sheet and said folded over side flaps.

8. An envelope, which comprises:

a rectangular front panel, said front panel having a pair of shorter edges and a pair of longer edges;

a sealing flap attached to a first of said shorter edges;

a pair of side flaps attached to said longer edges, said flaps being folded over said longer sides;

a back flap attached to the other of said shorter edges, said back flap being folded over said other shorter side and adhered to said side flaps;

a substantially rectangular filler sheet disposed between said back flap and said front panel adjacent said other shorter edge, said filler sheet having length substantially equal to the difference between in length between said longer sides and said shorter sides to define a substantially square card holding envelope portion between said filler sheet and said first shorter edge.

9. The envelope as claimed in claim 8, wherein said back flap is adhered to said filler sheet.

10. The envelope as claimed in claim 8, wherein said filler sheet is adhered to said front panel.

11. The envelope as claimed in claim 8, wherein said filler sheet is disposed between said side flaps.

12. The envelope as claimed in claim 11, wherein each of said side flaps has substantially equal width and the total of the widths of said side flaps and said filler sheet is substantially equal to the width of said front panel.

13. An envelope, which comprises:

a rectangular front panel defined by a pair of longer sides and a pair of shorter sides;

a sealing flap attached to a first of said sides;

a pair of side flaps attached to the sides adjacent said first side;

a back flap attached to the side opposite said first side; and, a substantially rectangular filler sheet adhered to front panel adjacent one of said shorter sides, said filler sheet having a width substantially equal the difference in length between said longer sides and said shorter sides to define a substantially square card holding envelope portion between said filler sheet and the other of said shorter sides.

14. The envelope as claimed in claim 13, wherein said first side is one of said shorter sides, and said filler sheet is adhered to the shorter side opposite said first side.

15. The envelope as claimed in claim 13, wherein said side flaps are folded over said front panel along said longer sides.

16. The envelope as claimed in claim 15, wherein said filler sheet has a length substantially equal to the distance between said folded over side flaps and said filler sheet is adhered to said front panel between said folded over side flaps.

17. The envelope as claimed in claim 16, wherein said back panel is adhered to said filler sheet and said folded over side flaps.

18. An envelope, which comprises:

a rectangular front panel, said front panel having a pair of shorter edges and a pair of longer edges;

a sealing flap attached to a first of said shorter edges;

a pair of side flaps attached to said longer edges, each of said side flaps having an edge opposite a longer side, said flaps being folded over said longer sides;

a back flap attached to the other of said shorter edges, said back flap being folded over said other shorter side and adhered to said side flaps;

a substantially rectangular filler sheet disposed between said back flap and said front panel adjacent said other shorter edge, and between said edges of said folded over side panels, said filler sheet having length substantially equal to the difference between in length between said longer sides and said shorter sides to define a substantially square card holding envelope portion between said filler sheet and said first shorter edge.

19. The envelope as claimed in claim 18, wherein said back flap is adhered to said filler sheet.

20. The envelope as claimed in claim 18, wherein said filler sheet is adhered to said front panel.

21. The envelope as claimed in claim 18, wherein each of said side flaps has substantially equal width and the total of the widths of said side flaps and said filler sheet is substantially equal to the width of said front panel.

* * * * *

UNITED STATES PATENT AND TRADEMARK OFFICE

CERTIFICATE OF CORRECTION

PATENT NO. : 6,182,886 B1
DATED : February 6, 2001
INVENTOR(S) : Michael E. Tucker, Jeffrey L. Quiett and John E. Cummings It is certified that error appears in the above-identified patent and that said Letters Patent is hereby corrected as shown below:

Column 2,
Line 61, before "filler sheet 31" add -- and --.

Column 3,
Line 65, delete "shorter," and replace with -- shorter side, --.

Column 4,
Line 21, delete "between in length between" and replace with
-- in length between --.

Column 5,
Line 12, delete "between in length between" and replace with
-- in length between --.

Signed and Sealed this

Fifth Day of March, 2002

*Attest:*

*Attesting Officer*

JAMES E. ROGAN
*Director of the United States Patent and Trademark Office*